US006840202B2

(12) United States Patent
Simpson

(10) Patent No.: US 6,840,202 B2
(45) Date of Patent: Jan. 11, 2005

(54) METHOD TO REDUCE NOISE OF A CAM PHASER BY CONTROLLING THE POSITION OF CENTER MOUNTED SPOOL VALVE

(75) Inventor: Roger T. Simpson, Ithaca, NY (US)

(73) Assignee: Borgwarner Inc., Auburn Hills, MI (US)

( * ) Notice: Subject to any disclaimer, the term of this patent is extended or adjusted under 35 U.S.C. 154(b) by 0 days.

(21) Appl. No.: 10/643,842

(22) Filed: Aug. 19, 2003

(65) Prior Publication Data

US 2004/0040525 A1 Mar. 4, 2004

Related U.S. Application Data

(60) Provisional application No. 60/407,885, filed on Sep. 3, 2002.

(51) Int. Cl.[7] ..... F01L 1/34

(52) U.S. Cl. ..... 123/90.17; 123/90.15; 123/90.31

(58) Field of Search ..... 123/90.17, 90.15, 123/90.31; 92/120–126, 85 B; 91/399, 405

(56) References Cited

U.S. PATENT DOCUMENTS

| | | | | |
|---|---|---|---|---|
| 3,845,694 | A * | 11/1974 | Berg | 91/402 |
| 5,002,023 | A | 3/1991 | Butterfield et al. | 123/90.15 |
| 5,107,804 | A | 4/1992 | Becker et al. | 123/90.17 |
| 5,172,659 | A | 12/1992 | Butterfield et al. | 123/90.17 |
| 5,184,578 | A | 2/1993 | Quinn, Jr. et al. | 123/90.17 |
| 5,289,805 | A | 3/1994 | Quinn, Jr. et al. | 123/90.17 |
| 5,361,735 | A | 11/1994 | Butterfield et al. | 123/90.17 |
| 5,497,738 | A | 3/1996 | Siemon et al. | 123/90.17 |
| 5,657,725 | A | 8/1997 | Butterfield et al. | 123/90.17 |
| 6,247,434 | B1 | 6/2001 | Simpson et al. | 123/90.17 |
| 6,250,265 | B1 | 6/2001 | Simpson | 123/90.17 |
| 6,263,846 | B1 | 7/2001 | Simpson et al. | 123/90.17 |
| 6,311,655 | B1 | 11/2001 | Simpson et al. | 123/90.17 |
| 6,374,787 | B2 | 4/2002 | Simpson et al. | 123/90.17 |
| 2003/0033999 | A1 * | 2/2003 | Gardner et al. | 123/90.17 |

* cited by examiner

*Primary Examiner*—Thomas Denion
*Assistant Examiner*—Zelalem Eshete
(74) *Attorney, Agent, or Firm*—Brown & Michaels, PC; Greg Dziegielewski

(57) ABSTRACT

To reduce the noise caused by torsional reversals of a rotor hitting the phaser housing in a VCT cam timing system. A cam torque actuated phaser (phaser with check valves) the control loop is opened and rather then moving the spool valve to one end or the other end, the spool valve is moved just slightly off null. By doing this the oil ports in the spool passageways that control the motion of the phaser are restricted and the motion of the phaser is reduced. Therefore the noise of the phaser is reduced.

8 Claims, 9 Drawing Sheets

METHOD TO REDUCE NOISE OF A CAM PHASER BY CONTROLLING THE POSITION OF CENTER MOUNTED SPOOL VALVE

REFERENCE TO RELATED APPLICATIONS

This application claims an invention which was disclosed in Provisional Application No. 60/407,885, filed Sep. 3, 2002, entitled "METHOD TO REDUCE NOISE OF A CAM PHASER BY CONTROLLING THE POSITION OF CENTER MOUNTED SPOOL VALVE". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable camshaft timing (VCT) systems. More particularly, the invention pertains to method and apparatus to reduce noise of a cam Phaser by controlling the position of center mounted spool valve.

2. Description of Related Art

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

Consideration of information disclosed by the following U.S. patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control algorithm that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes a camshaft has a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposed end in response to a signal from an engine control unit. The vane can be biased to an extreme position to provide a counteractive force to a unidirectionally acting frictional torque experienced by the camshaft during rotation.

U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,250,265 shows a variable valve timing system with actuator locking for internal combustion engine. The system comprising a variable camshaft timing system comprising a camshaft with a vane secured to the camshaft for rotation with the camshaft but not for oscillation with respect to the camshaft. The vane has a circumferentially extending plurality of lobes projecting radially outwardly therefrom and is surrounded by an annular housing that has a corresponding plurality of recesses each of which receives one of the lobes and has a circumferential extent greater than the circumferential extent of the lobe received therein to permit oscillation of the housing relative to the vane and the camshaft while the housing rotates with the camshaft and the vane. Oscillation of the housing relative to the vane and the camshaft is actuated by pressurized engine oil in each of the recesses on opposed sides of the lobe therein, the oil pressure in such recess being preferably derived in part from a torque pulse in the camshaft as it rotates during its operation. An annular locking plate is positioned coaxially with the camshaft and the annular housing and is moveable relative to the annular housing along a longitudinal central axis of the camshaft between a first position, where the locking plate engages the annular housing to prevent its circumferential movement relative to the vane and a second position where circumferential movement of the annular housing relative to the vane is permitted. The locking plate is biased by a spring toward its first position and is urged away from its first position toward its second position by engine oil pressure, to which it is exposed by a passage leading through the camshaft, when engine oil pressure is sufficiently high to overcome the spring biasing force, which is the only time when it is desired to change the relative positions of the annular housing and the vane. The movement of the locking plate is controlled by an engine electronic control unit either through a closed loop control system or an open loop control system.

U.S. Pat. No. 6,263,846 shows a control valve strategy for vane-type variable camshaft timing system. The strategy involves an internal combustion engine that includes a camshaft and hub secured to the camshaft for rotation therewith, where a housing circumscribes the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes to define circumferentially alternating advance and retard chambers. A configuration for controlling the oscillation of the housing relative to the hub includes an electronic engine control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft is discribed. A housing circumscribes the rotor, is rotatable with both the rotor and the camshaft, and is further oscillatable with respect to both the rotor and the camshaft between a fully retarded position and a filly advanced position. A locking configuration prevents relative motion between the rotor and the housing, and is mounted within either the rotor or the housing, and is respectively and releasably engageable with the other of either the rotor and the housing in the fully retarded position, the fully advanced position, and in positions therebetween. The locking device includes a locking piston having keys terminating one end thereof, and serrations mounted opposite the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

Referring to FIG. 1, a typical prior art feedback loop 10 is shown. The control objective of feedback loop 10 is to have a phaser disposed at a specified position, e.g. a spool valve in a null position by means of some type of actuator engaging a spool valve. In other words, the objective is to have no fluid flowing between two fluid holding chambers of a phaser (not shown) such that the VCT mechanism at the phase angle given by a set point 12 with the spool 14 stationary in its null position. This way, the VCT mechanism is at a desired phase position and the phase rate of change is zero. A control computer program product which utilizes the dynamic state of the VCT mechanism is used to accomplish the above state. The computer program product may either reside in the engine control unit (ECU), or it may reside somewhere independent of ECU.

The VCT closed-loop control mechanism is achieved by measuring a camshaft phase shift .$\theta_0$ 16, and comparing the same to the desired set point r 12. The VCT mechanism is in turn adjusted so that the phaser achieves a position which is determined by the set point 12. A control law 18 compares the set point 12 to the phase shift $\theta_0$ 16. The compared result is used as a reference to issue commands to an actuator such as solenoid 20 to position the spool 14. This positioning of spool 14 occurs when the phase error (the difference between set point 12 and phase shift 16) is non-zero.

The spool 14 is moved toward a first direction (e.g. right) if the phase error is positive (retard) and to a second direction (e.g. left) if the phase error is negative (advance). When the phase error is zero, the VCT phase equals the set point r 12. At this juncture, there is no need for adjustment as far as the feedback loop is concerned, so the spool 14 is held in the null position such that no fluid flows within the spool valve.

Camshaft and crankshaft measurement pulses in the VCT system are generated by camshaft and crankshaft pulse wheels 22 and 24, respectively. As the crankshaft (not shown) and camshaft (also not shown) rotate, wheels 22, 24 rotate along with them. The wheels 22, 24 possess teeth which can be sensed and measured by sensors according to measurement pulses generated by the sensors. The measurement pulses are detected by camshaft and crankshaft measurement pulse sensors 22*a* and 24*a*, respectively. The sensed pulses are used by a phase measurement device 26. A measurement phase difference is then determined. The phase difference is defined as the time from successive crank-to-cam pulses, divided by the time for an entire revolution and multiplied by 360.degree. The measured phase difference may be expressed as $\theta_0$ 16. This phase difference is then supplied to the control law 18 for reaching the desired spool position.

A control law 18 of the closed-loop 10 is described in U.S. Pat. No. 5,184,578 and is hereby incorporate herein by reference. A simplified depiction of the control law is shown in FIG. 2. Measured phase 26 is subjected to the control law 18 initially at block 30 wherein a phase integration (PI) process occurs. Typically phase integration process is subdivided into two sub-processes. The first sub-process includes an amplification action; and the second sub-process includes an integration action. Measured phase is further subjected to phase compensation at block 32. Typically, a phase lag of the measured phase 26 is corrected therein.

When controlling the position of a Phaser in relation to a phase angle set point 12, the controlling spool valve 14 is at, or near its null position. To move the Phaser, the valve 14 is moved towards one end or the other end in proportion to the amount of error in the control loop. As shown supra, the error is the difference between the set point 12 and the phase angle 16 $\theta_0$ position feedback. When the Phaser is commanded to move to the mechanical stop or its mechanical limit, the control loop becomes ineffective because the position of the Phaser is dictated or limited by the positional stops and not by the error signal. For example, when the vane encounters a physical limit or stop in a housing but is still commanded to move toward the physically impossible direction, the integrator within the loop or the control law accumulates physically inaccurate hence undesirable information. In fact, when the Phaser is at its mechanical or physical stops, the error signal can cause the PID integrator 30 to try to move the spool valve 14. This causes the integrator 30 to keep increasing the error signal to try to move the Phaser. In order to stop this undesirable occurrence from happening, the usual method is to open the control loop and command the solenoid 20 to either full on or full off when it is within a few degrees of the positional stops. This approach may work well for a Phaser that uses oil pressure to move the Phaser but can cause noise for a Phaser that utilizes cam Torsionals to move the Phaser back and forth. Such torsional assisted phasers include the CTA patents listed supra such as the U.S. Pat. No. 5,657,725 commonly assigned to BorgWarner Inc, as well as single and dual check torsional assisted (TA) and the DM phasers.

Referring to FIG. 3, a prior art phaser 34 having a 4-way valve is shown. A pulse width modulated (PWM) 3 way valves (not shown) may also be used herein. Both of which are remotely mounted. A valve is remotely mounted in that the valve such as the spool valve 36 is not within the proximity of phaser chambers or rotor. A vane (not shown) divides a housing 38 into an advance chamber 40 and a retard chamber 42. A supply line 44 supplies pressurized fluid such as engine oil into the phaser chambers. Thereby the pressurized fluid in the phaser selectively causes the vane to move in one direction or the reverse of the direction according to a command. The result is that the fluid flowing into advance chamber 40 increasing the dimension thereto and the fluid flowing out of retard chamber 42 decreasing its dimension, or vice versa. The flowing of the fluid is enabled by an advance duct 46 and retard duct 48 working in conjunction. Both ducts 46, 48 possess a substantial length. Advance duct 46 has a first end connected to advance chamber 40 and a second end a second end connected to valve housing 50. Similarly, retard duct 48 has a first end connected to retard chamber 42 and a second end a second end connected to valve housing 50. Fluid flowing within both ducts can be controllably stopped by valve 36 which is engaged by an actuator 52. An outlet of the fluid is provided by an exhaust duct 54. It is noted that the exact position of the spool valve 36 in relation to the fluid ducts is not shown exactly. The control of the spool valve 36 can be any control mean described supra. A more detailed or exact depiction of the same is shown in FIGS. 4A, 4B, and 4C.

Referring to FIG. 4A, spool valve 36 at null position is shown. According to design requirements, at null position no fluid flows because spool valve stops the fluid from flowing by means of having both advance duct 46 and retard duct 48 blocked or sealed. At full advance position, as shown in FIG. 4B, spool 36 moves to a first position where supply fluid 44 is allowed to supply fluid via the spool valve 36, and ducts 46, 48 are permitted the unidirectional flow as shown. The unidirectional flow occurs because of the check valves or unidirectional valves (not shown). Exhaust duct 54*a* facilitates or completes the fluid circuit (only partially shown herein). At full retard position, as shown in FIG. 4C, spool 36 moves to a second position where supply fluid 44 is allowed to supply fluid, and ducts 46, 48 are permitted the unidirectional flow as shown because of the check valves or unidirectional valves (not shown). Exhaust duct 54*b* facilitates or completes the fluid circuit (only partially shown herein).

The graphs besides FIGS. 4A–4C indicate respectively the functional relationship between spool position (x-coordinate) and the flow rate (y-coordinate) into or out of chambers 40, 42. Further, note that spool 36 causes the ducts to be either completely upon or completely closed.

Referring now to FIG. 5, a known phaser is shown. Such phaser can be a phaser described in U.S. Pat. No. 5,107,804 by Thomas, J. Becker et al, commonly assigned to Borg-Warner Automotive & Engine Components Corporation. The phaser includes a housing 1 and a rotor 2. Housing 1 and rotor 2 are rotably coupled together. In other words, the phaser is interposed between two shafts. One of the shaft is a cam shaft 4 which, in this case, is rigidly attached to rotor 2. Housing 1, in turn, is rigidly attached to sprocket having a number of teeth 8 engaging a chain 9.

Referring again to FIGS. 3–5, advance duct 46 leads to advance chamber(s) and retard duct 48 leads to retard chamber(s). A pair of vanes 56 being an integral part of rotor 2 extends respectively into a pair of chamber region dividing the region into advance and retard chambers 40, 42 respectively. In a first advance chamber 40, a first wall 40*a* acts as a physical stop when a vane side wall 56*a* of vane 56 comes in direct physical contact with first wall 40*a*. Similarly, in a second advance chamber 40, a second wall 40*b* acts as a physical stop when a vane side wall 56*b* of vane 56 comes in direct physical contact with second wall 40*b*. Thereby, the rotable movement of vane 56 in relation to housing 1 is physically stopped when the direct physical contact occurs.

When spool valve 36 is commanded to advance or retard the vane 56, it may rotate toward the first wall 40*a* (see FIG. 4B) or rotate in the reverse direction (see FIG. 4C). When surfaces 56*a*, 56*b* are in the close proximity to, or in actual physical contact with, surfaces 40*a*, 40*b* respectively, noise occurs as a result of the physical contact between surfaces including surfaces 40*a* 56*a* and 40*b* 56*b*.

When spool valve 36 is positioned at either fully advance or fully regard positions respectively, fluid is allowed to flow at its maximum rate (see graphs of FIGS. 4B and 4C. At full advance, the result is that full pressure is applied to keep phaser at full advance. Similarly, at full retard, full pressure is applied to keep phaser at full retard. For example, at full advance, surfaces 40*a* and 56*a* are at close proximity to each other or are in actual physical contact with each other. Typically, the force of the fluid flow is caused by torsional act of the cam shaft 4. As a result, noise occurs due to the oscillation of the vane at or near its physical stop at either end of its travel.

It is noted that similar surfaces exist in the pair of retard chamber 42. Typically, the physical components in the chamber area are symmetrical. Therefore, description of the same is omitted herein.

As can be appreciated, in a VCT system using torsionals to move a phaser back and forth, it is desirous to have a suitable device or process for eliminating noise at or in the proximity of the phase's physical stops or end of travel. Particularly, it is desirous to reduce noise in a TA and Dual Mode phaser used in an internal combustion engine.

SUMMARY OF THE INVENTION

A method is provided for reducing the error caused by a PID integrator to try to move the spool valve when a phaser is at its physical stops.

In a VCT system using cam torsionals to move the phaser back and forth, a method is provided to reduce noise of the phaser in the case when a controller is not aware of positional stops and the integrator under its control keeps increasing the error signal to try to move the phaser.

In a VCT system using cam torsionals to move the phaser back and forth, a method is provided to reduce noise of the phaser housing, due to cam torsional reversals, causes noise at the stops.

In a VCT system, a method is provided to reduce noise on a cam torque actuated phaser (phaser with check valves) the control loop is opened and rather then moving the spool valve to one end or the other end, the spool valve is moved just slightly off null.

In a VCT system using cam torsionals to move the phaser back and forth, a method is provided such that the oil ports in the spool passageways that control the motion of the phaser are restricted and phaser motion is reduced. Thereby the noise of the phaser is reduces Accordingly, in a cam torque actuated phaser disposed between a first moving shaft and a second moving shaft. The phaser has a first end connected to the first moving shaft, and a second end connected to the second moving shaft. The phaser further has housing connected to the first end and a rotor connected to the second end. The rotor forms at least one vane disposed within the housing. The vane divides the housing into an advance chamber and a retard chamber. The vane is limited by at least one physical stop caused by an inside surface of the housing. The phaser is coupled to at least one check valve. In addition, the phaser is further controlled by a feed back control loop which has a control law, wherein an integrator accumulates a plurality of error signals resulting from the difference between a set point control signal and a feedback signal. The phaser further includes a spool valve having a predetermined null position. A method involving the phaser comprising the step of moving the spool valve just off the predetermined null position causing the vane to be positioned at a substantial distance away from the physical stops, thereby reducing noise caused by the vane coming in contact with the housing.

DETAILED DESCRIPTION OF THE INVENTION

As shown supra, when spool valve 36 is at full advance position, noise occurs because the vane encounters the physical stop which is caused by the physical confines of the advance chamber.

Figure 1:
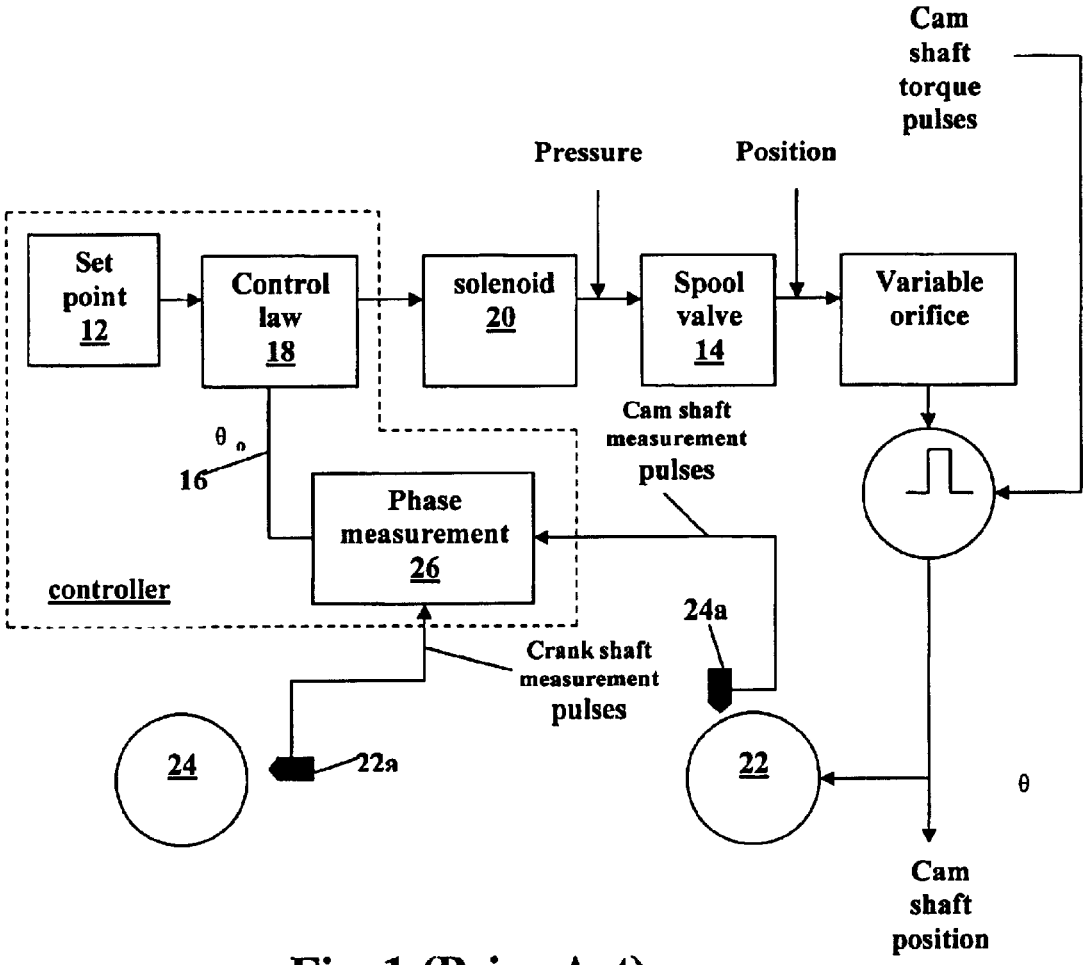
Fig. 1 (Prior Art)
FIG. 1 shows a prior art feed back control loop.
Figure 2:
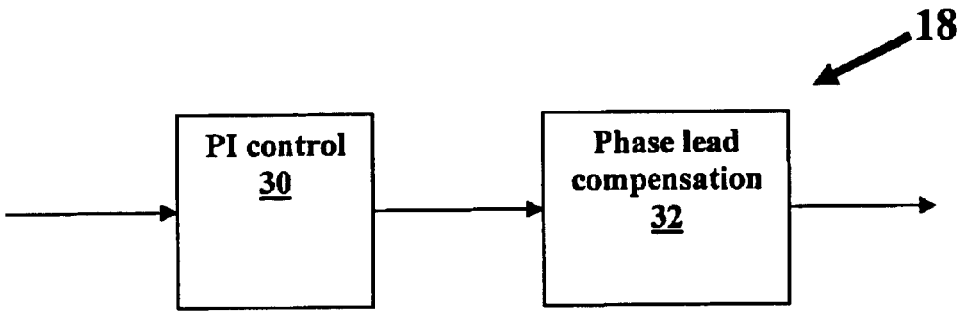
Fig. 2 (Prior Art)
FIG. 2 shows a prior art control law of the feedback control loop of FIG. 1.
Figure 3:
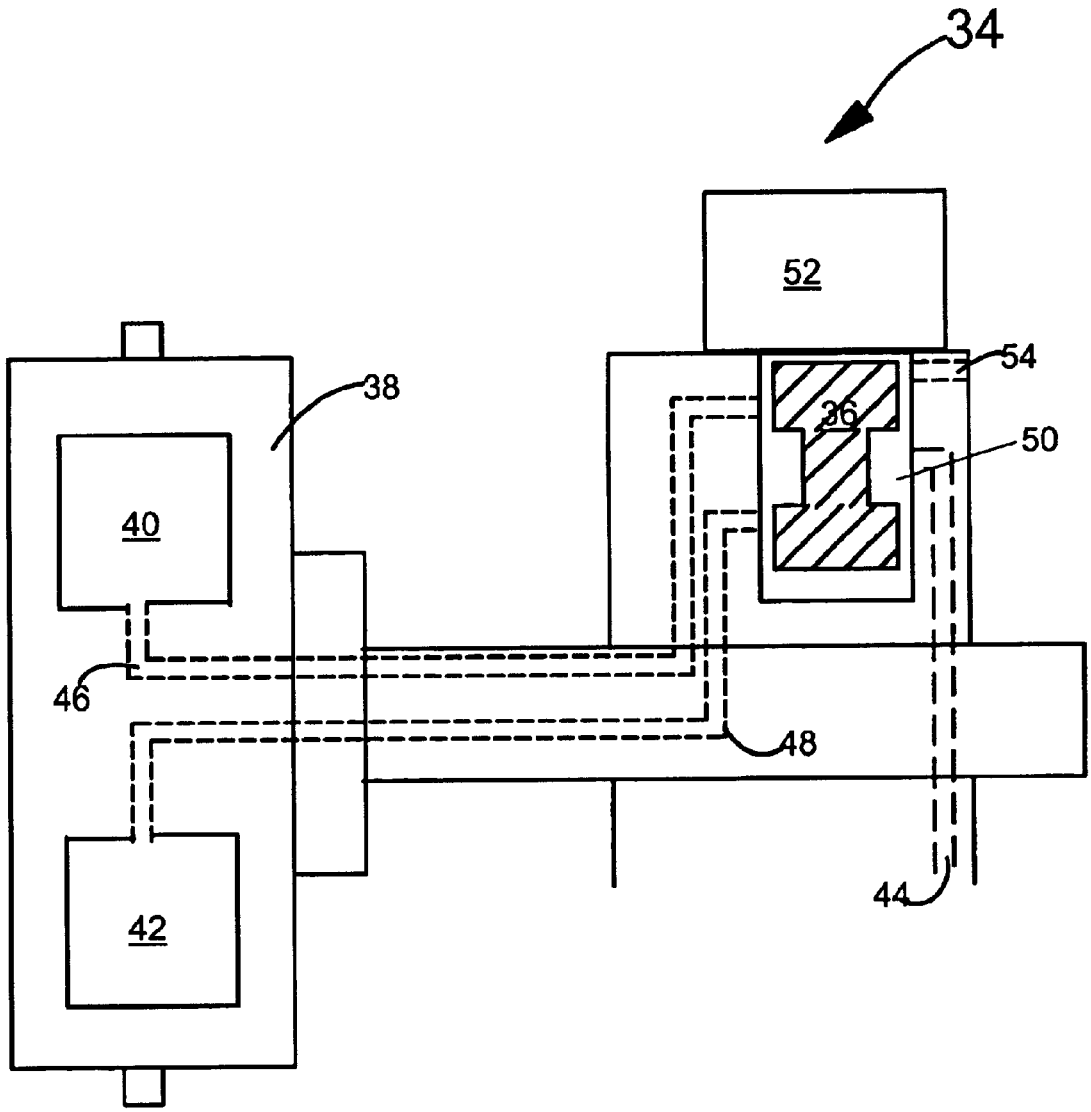
Fig. 3 (Prior Art)
FIG. 3 shows a prior art phaser.
Figure 4A:
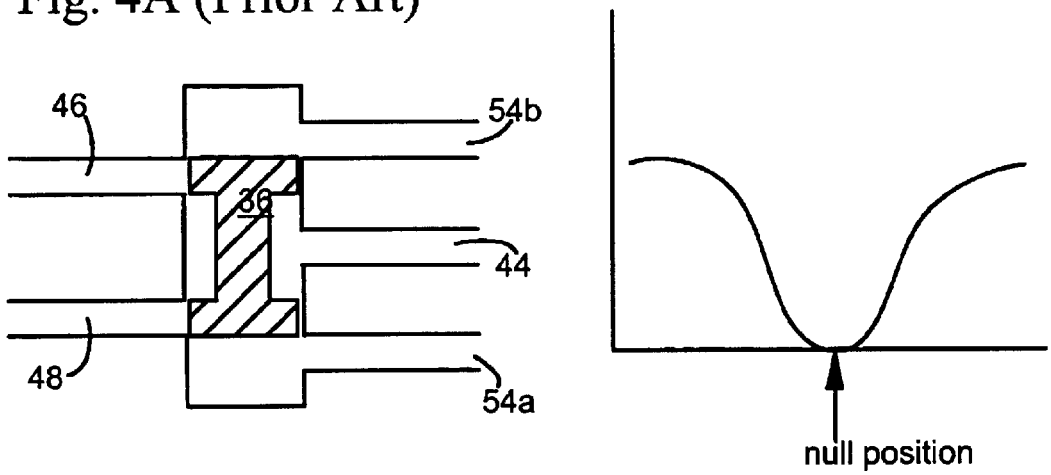
Fig. 4A (Prior Art)
FIG. 4*a* shows a spool valve at command or null position.
Figure 4B:
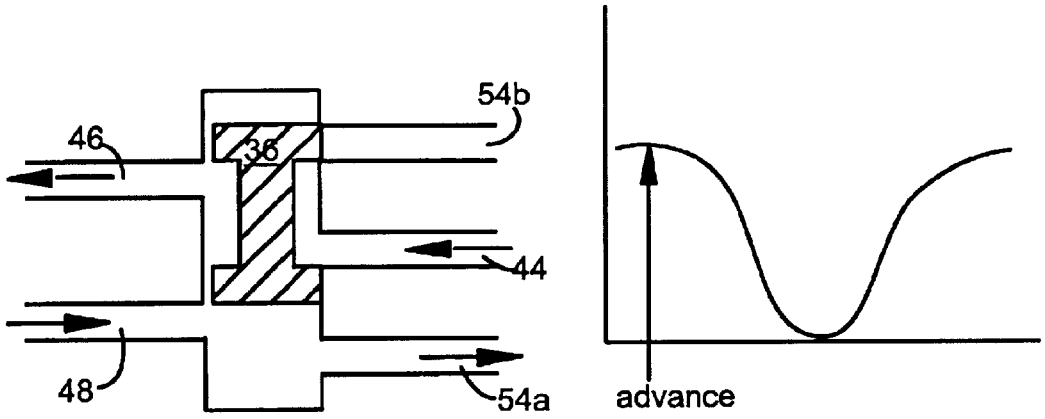
Fig. 4B (Prior Art)
FIG. 4*b* shows a spool valve at advance position.
Figure 4C:
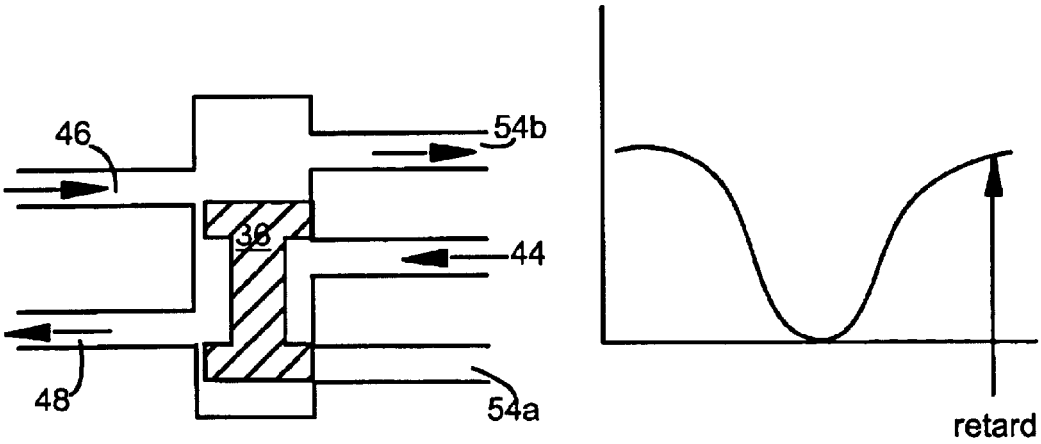
Fig. 4C (Prior Art)
FIG. 4*c* shows a spool valve at retard position.
Figure 5:
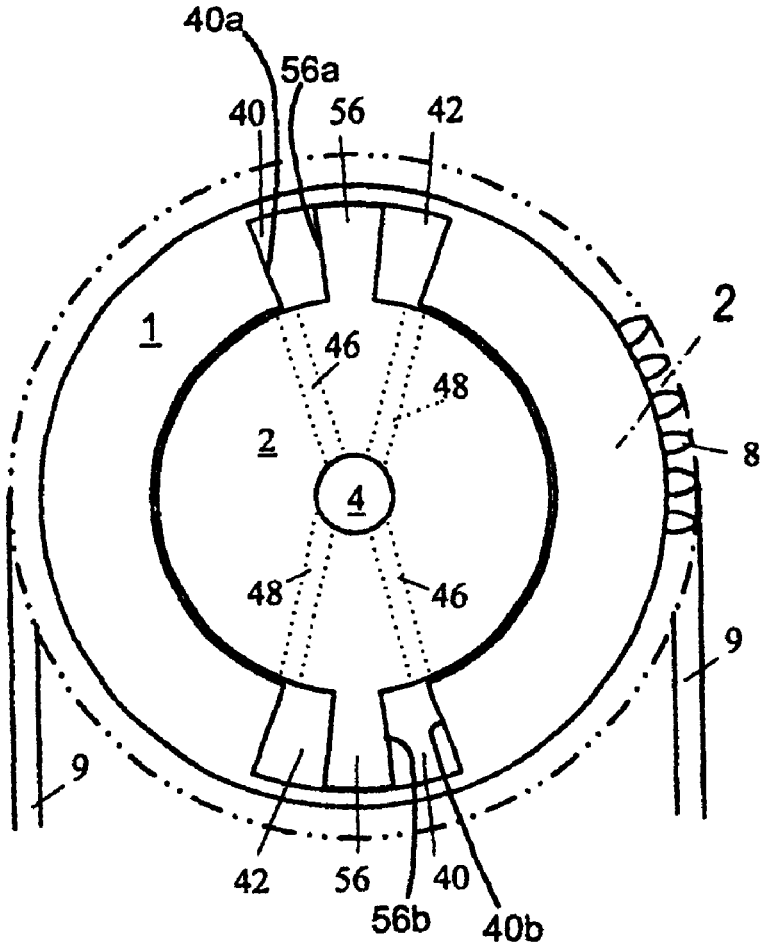
Fig.5 (Prior Art)
FIG. 5 shows a prior art vane phaser.
Figure 6:
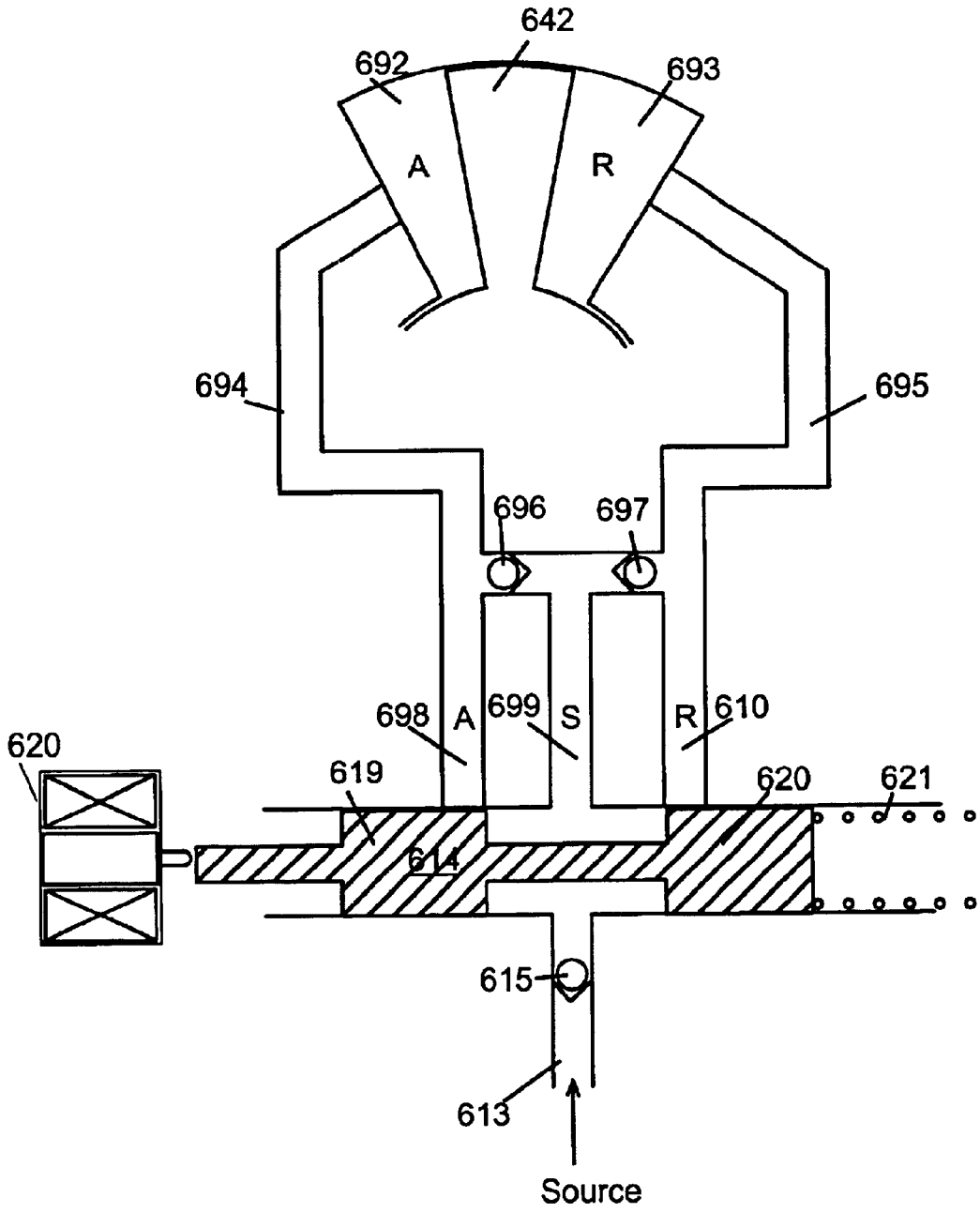
FIG. 6 shows a Cam Torque Actuated (CTA) VCT system applicable to the present invention.

Referring to FIG. 6, a Cam Torque Actuated (CTA) VCT system applicable to the present invention is shown. The CTA system uses torque reversals in camshaft caused by the forces of opening and closing engine valves to move vane 642. The control valve in a CTA system allows fluid flow from advance chamber 692 to retard chamber 693 or vice versa, allowing vane 642 to move, or stops fluid flow, locking vane 642 in position. CTA phaser may also have oil input 613 to make up for losses due to leakage, but does not use engine oil pressure to move phaser.

The detailed operation of CTA phaser system is as follows. FIG. 6 depicts a null position in that ideally no fluid flow occurs because the spool valve 614 stops fluid circulation at both advance end 698 and retard end 610. When cam angular relationship is required to be changed, vane 642 necessarily needs to move. Solenoid 620, which engages spool valve 614, is commanded to move spool 614 away from the null position thereby causing fluid within the CTA circulation to flow. It is pointed out that the CTA circulation ideally uses only local fluid without any fluid coming from source 613. However, during normal operation, some fluid leakage occurs and the fluid deficit needs to be replenished by the source 613 via a one way valve 614. The fluid in this case may be engine oil. The source 613 may be the oil pan.

There are two scenarios for the CTA phaser system. First, there is the Advance scenario, wherein an Advance chamber 692 needs to be filled with more fluid than in the null position. In other words, the size or volume of chamber 692 is increased. The advance scenario is accomplished by way of the following.

Solenoid 620, preferably of the pulse width modulation (PWM) type, pushes the spool valve 614 toward right such that the left portion 619 of the spool valve 614 still stops fluid flow at the advance end 698. But simultaneously the right portion 620 moved further right leaving retard portion 610 in fluid communication with duct 699. Because of the inherent torque reversals in camshaft, drained fluid from the retard chamber 693 feeds the same into advance chamber 692 via one-way valve 696 and duct 694.

Similarly, for the second scenario which is the retard scenario wherein a Retard chamber 693 needs to be filled with more fluid than in the null position. In other words, the size or volume of chamber 693 is increased. The retard scenario is accomplished by way of the following.

Solenoid 620, preferably of the pulse width modulation (PWM) type, reduces its engaging force with the spool valve 614 such that an elastic member 621 forces spool 614 to move left. The right portion 620 of the spool valve 615 stops fluid flow at the retard end 610. But simultaneously the left portion 619 moves further right leaving Advance portion 698 in fluid communication with duct 699. Because of the inherent torque reversals in camshaft, drained fluid from the Advance chamber 692 feeds the same into Retard chamber 693 via one-way valve 697 and duct 695.

It will be recognized by one skilled in the art that this description is common to torsional actuated VCT vane phasers in general, and the specific arrangement of vanes, chambers, passages and valves shown in FIG. 6 may be varied within the teachings of the invention. For example, the number of vanes and their location can be changed, some phasers may have only a single vane, others as many as a dozen, and the vanes might be located on the housing and reciprocate within chambers on the rotor.

In addition, the actuator type is not limited to PWM type. The actuator may be any type of variable force solenoid, stepper motor, vacuum actuator, or oil pressure controlled piston which can be either located in proximity to the VCT system (internally), or away from the system (externally).

Further, the spool valve is preferably located within such as in the center or close proximity of the rotor, in stead of remote to the rotor.

As can be appreciated, FIG. 6 is an idealized operation of a CTA phaser system. When real physical CTA systems are under operation, factors such as CTA phaser's inherent torsionals causes oscillation, which in turn generates noise such as the vane hitting elements at its end of travel. In order to overcome the occurrence of the noise, the following device and method is devised as shown in FIGS. 7*a*–8*c*.

Figure 7A:
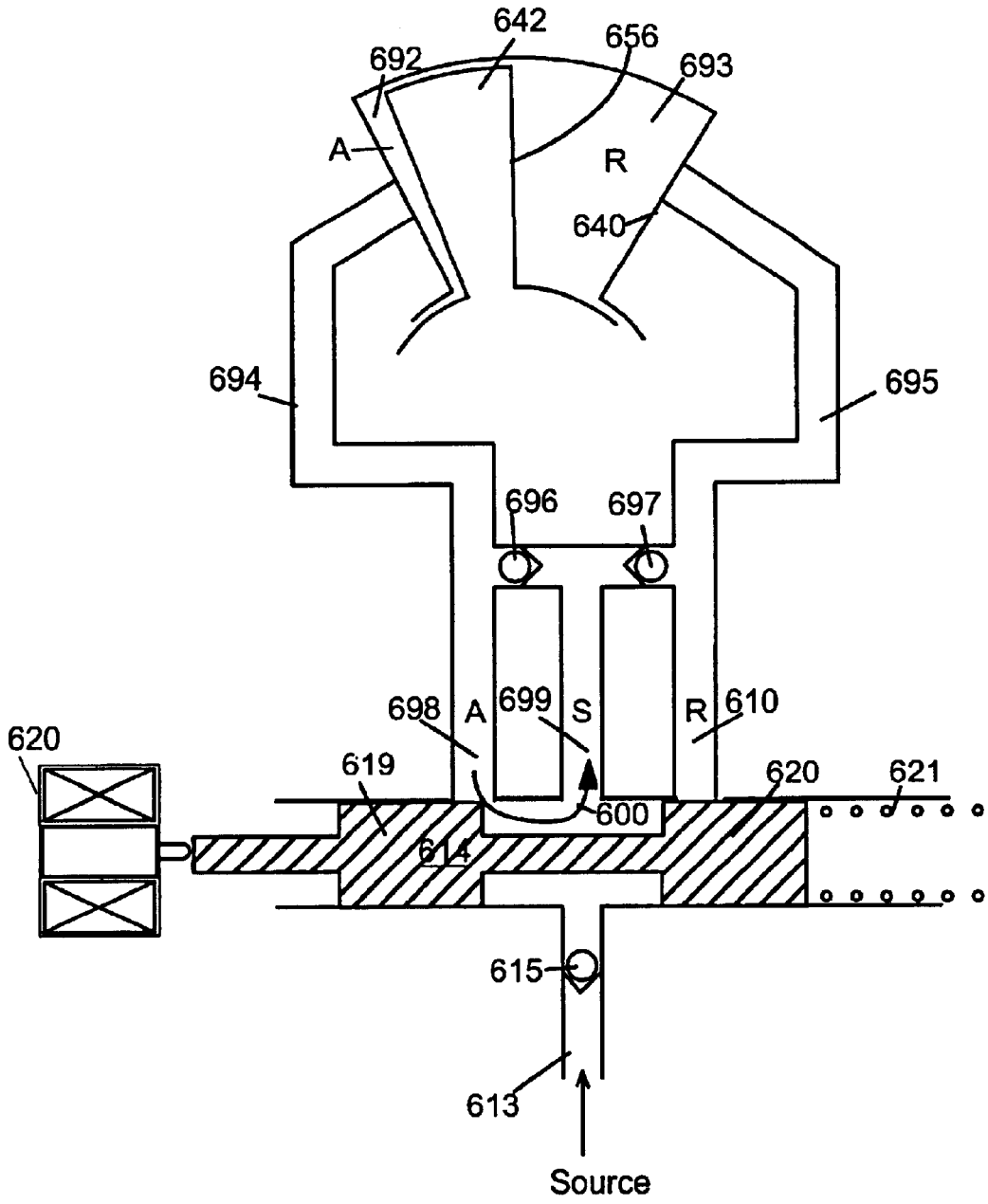
FIG. 7*a* shows the spool at a first off null position.

Referring to 7*a*, spool 614 is controlled to just move left sufficient enough to cause a flow 600 to overcome torsional vibrations and keeping the angular relationship of the phaser substantially intact. In other words, when surface 656 of vane 642 is sufficiently close to surface 640, torsional vibrations can cause undesirable noise. Flow 600 let out fluid just enough out of chamber A to keep the undesirable noise from occurring. As can be appreciated, noise occurs by the vane hitting the side of the housing. By having the spool valve close to the null, the oil flow of the chamber is further restricted then if the valve is at the null position. As shown in FIG. 7*a* the vane 642 is substantially away from its end of travel to the left for FIG. 7*a*.

Figure 7B:
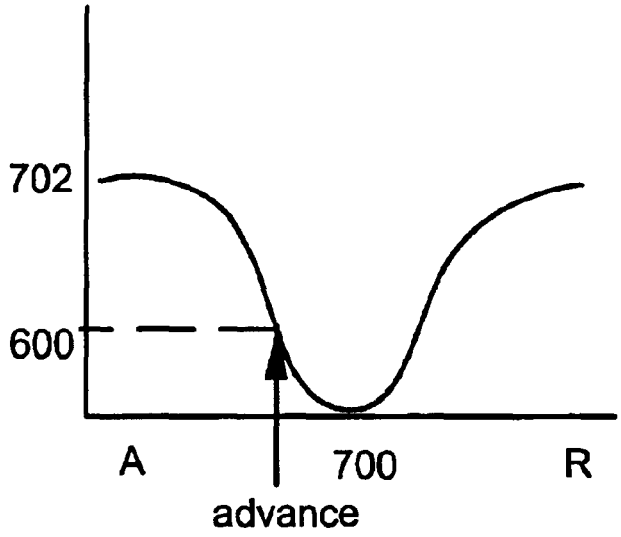
FIG. 7*b* shows a functional relationship of FIG. 7*a*.

Referring to FIG. 7*b*, the y-coordinate stands for fluid flow rate and the x-coordinate stands for spool position. Position 700 stands for null position and flow rate 702 stands for maximum flow rate of a phaser. The right side of position 700 denotes advance scenario, and the left side of position 700 denotes retard scenario. At position A, full flow rate can be achieved and maintained in its neighborhood for the advance scenario. Similarly, at position R, full flow rate can be achieved and maintained in its neighborhood for the retard scenario. It is found in practice that when noise is generated, the position of spool valve just off null reduces the noise when the vane is close to the physical stop of the housing. The arrow indicates the general position of the spool valve in the advance side. By just moving the spool valve a little to the advance side, some control fluid flows slowly toward the retard chamber (R) sufficient enough to thereby stop the physical contact between surface 640 and surface 656. This way, noise is stopped in that even with some oscillation, the two surfaces, surface 640 and surface 656, are less likely to come into contact thereby causing noise to occur.

Referring again to FIGS. 7*a* and 7*b*, the feedback control loop is left open in that sensed signals and the error accumulation in the integrator is ignored. A controller such as an engine control unit (ECU) is used to push or pull the spool valve just off its null position.

Similarly, referring to 8*a*, spool 614 is controlled to just move right sufficient enough to cause a flow 601 to overcome torsional vibrations and keeping the angular relationship of the phaser substantially intact. In other words, when surface 657 of vane 642 is sufficiently close to surface 641, torsional vibrations can cause undesirable noise. Flow 6010 let out fluid just enough out of chamber A to keep the undesirable noise from occurring. It is noted that only when the vane is close to the housing is the spool valve moved slightly away form the null position. This reduces the noise.

Figure 8B:
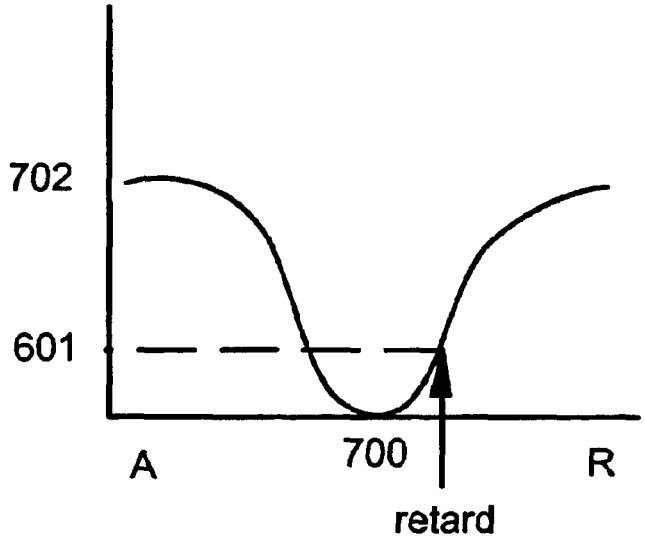
FIG. 8*b* shows a functional relationship of FIG. 8*a*.
Figure 8A:
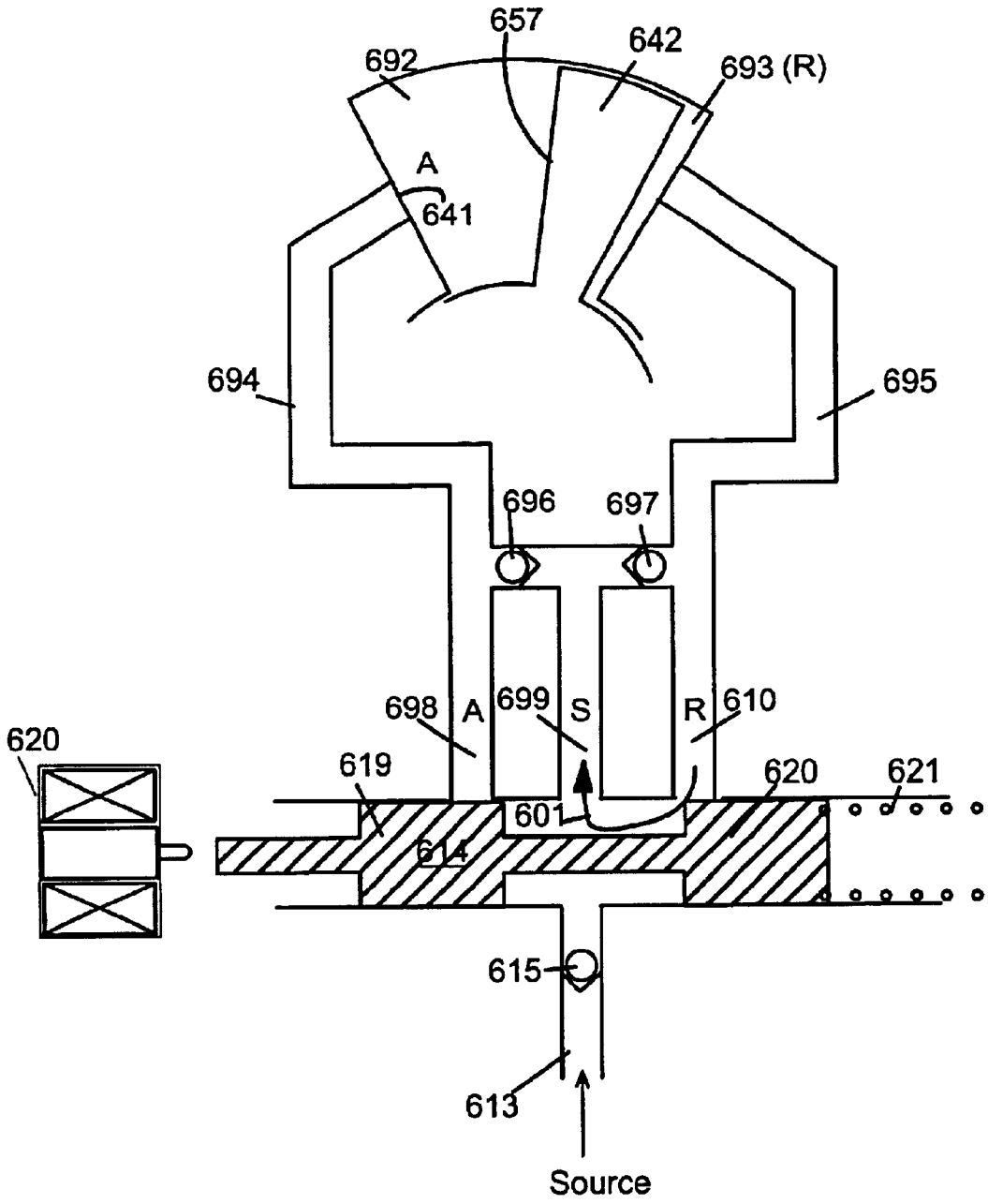
FIG. 8*a* shows the spool at a second off null position.

Referring to FIG. 8*b*, similar to FIG. 7*b*, the y-coordinate stands for fluid flow rate and the x-coordinate stands for spool position. Position 700 stands for null position and flow rate 702 stands for maximum flow rate of a phaser. The right side of position 700 denotes advance scenario, and the left side of position 700 denotes retard scenario. At position A, full flow rate can be achieved and maintained in its neighborhood for the advance scenario. Similarly, at position R, full flow rate can be achieved and maintained in its neighborhood for the retard scenario. It is found in practice that when noise is generated, the position of spool valve just off null reduces the noise. The arrow indicates the general position of the spool valve in the advance side. Similar to FIG. 7*a*, surfaces 657 641 are kept apart by slight moving the spool 614 away from its null position.

In the practice of the present invention, when controlling the position of a Phaser to a phase angle set point, the controlling spool valve is at or near its null position. To move the Phaser, the valve is moved towards one end or the other end proportional to the amount of error in the control loop. The error is the difference between the set point and the phase angle position feedback. When the Phaser is commanded to move to the mechanical stop the control loop becomes ineffective because the position of the Phaser is dictated or physically limited by the positional stops and not by the error signal determined by a controller. When the Phaser is at its positional stops, the error signal can cause the PID integrator to try to move the spool valve. Because the controller is not aware of positional stops, the integrator under its control keeps increasing the error signal to try to move the Phaser. In order to stop this from happening, the usual method is to open the control loop and command the solenoid to either full on or full off when it (vane) is within a few degrees of the positional stops. This approach may work well for a Phaser that uses oil pressure to move the Phaser, but can cause noise for a Phaser that utilizes cam Torsionals to move the Phaser back and forth. Such torsional assisted phasers include the BW CTA patents listed in the background section of the instant application and Torsional assist patents such as U.S. Pat. No. 5,657,725 (Haesloop, Butterfield and single and dual check TA and the DM phasers).

As can be seen, the rotor hitting the Phaser housing due to cam Torsional reversals causes noise at the stops. To reduce this noise on a Cam torque Actuated Phaser (e.g., Phaser with check valves) the control loop is opened. At this juncture, rather then moving the spool valve to one end or the other end, the spool valve is moved just slightly off null. By way of example, refer to FIGS. 7*b* and 8*b*. By doing this the fluid ports in the spool passageways that control the motion of the Phaser are restricted. Further, the motion of the Phaser is reduced, thereby reducing the noise of the Phaser.

It is noted that with a Phaser that uses engine oil pressure to move the rotor back and forth the valve is opened all the way to allow all the engine pressure to push the rotor against the sprocket housing. Further, the present invention contemplates the use of the same involving OPA VCT systems.

The following are terms and concepts relating to the present invention.

It is noted just off the predetermined null is defined as or understood to be the positioning a spool valve sufficiently enough for flow of fluid to reduce noise. For details, refer to FIGS. 7*a*–8*b* supra.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA) VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Camber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA) or Torque Assisted phaser is a variation on the OPA phaser, which adds a check valve in the oil supply line (i.e. a single check valve embodiment) or a check valve in the supply line to each chamber (i.e. two check-valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is a step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

One embodiment of the invention is implemented as a program product for use with a computer system such as, for example, an automobile control system with an ECU acting as a controller. The program(s) of the program product defines functions of the embodiments (including the methods claimed and described herein, and can be contained on a variety of signal-bearing media. Illustrative signal-bearing media include, but are not limited to: (i) information permanently stored on in-circuit programmable devices like PROM, EPPOM, etc; (ii) information permanently stored on non-writable storage media (e.g., read-only memory devices within a computer such as CD-ROM disks readable by a CD-ROM drive); (iii) alterable information stored on writable storage media (e.g., floppy disks within a diskette drive or hard-disk drive); (iv) information conveyed to a computer by a communications medium, such as through a computer or telephone network, including wireless communications, or a vehicle controller of an automobile. Some embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, whether implemented as part of an operating system or a specific application, component, program, module, object, or sequence of instructions may be referred to herein as a "program". The computer program typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. In a variable cam timing phaser disposed between a first moving shaft and a second moving shaft, the phaser having a first end connected to the first moving shaft, and a second end connected to the second moving shaft; a housing connected to the first end and a rotor connected to the second end, the rotor forming at least one vane disposed within the housing and dividing the housing into an advance chamber and a retard chamber, the vane being limited by at least one physical stop caused by an inside surface of the housing; the phaser being coupled to at least one check valve; the phaser being further controlled by a feed back control loop having a control law, wherein an integrator accumulates a plurality of error signals resulting from the difference between a set point control signal and a feedback signal; the phaser further including a spool valve having a predetermined null position; a method involving the phaser comprising:

moving the spool valve just off the predetermined null position;

permitting control fluid to flow at a substantially slow rate; and causing the vane to be positioned at a substantial distance away from the physical stops, thereby reducing noise caused by the vane coming in contact with the housing.

2. The method of claim 1 further comprising the step of opening the loop.

3. The method of claim 1, wherein the spool valve is center mounted within the phaser.

4. The method of claim 1, wherein the step of moving the spool valve just off the predetermined null position includes moving the spool valve toward a retard direction or an advance direction.

5. The method of claim 1, wherein the predetermined null position is determined by a controller.

6. The method of claim 1, wherein the engine controller is an ECU.

7. The method of claim 1, wherein the variable cam timing phaser is a torsional assist (TA) phaser.

8. The method of claim 1, wherein the variable cam timing phaser is cam torque actuated (CTA) phaser.

* * * * *

UNITED STATES PATENT AND TRADEMARK OFFICE

CERTIFICATE OF CORRECTION

PATENT NO. : 6,840,202 B2
DATED : January 11, 2005
INVENTOR(S) : Simpson

It is certified that error appears in the above-identified patent and that said Letters Patent is hereby corrected as shown below:

Title page,
Item [73], Assignee, should read -- BorgWarner Inc., Auburn Hills, MI (US) --

Signed and Sealed this

Seventh Day of June, 2005

JON W. DUDAS
*Director of the United States Patent and Trademark Office*